United States Patent [19]

Moore

[11] 4,359,187

[45] Nov. 16, 1982

[54] ENERGY RECOVERY SYSTEM

[76] Inventor: Richard F. Moore, 400 Booth Hill Rd., Trumbull, Conn. 06611

[21] Appl. No.: 148,799

[22] Filed: May 12, 1980

[51] Int. Cl.[3] ..... F24B 7/00

[52] U.S. Cl. ..... 237/55; 165/DIG. 2; 126/99 R

[58] Field of Search ..... 237/55, 52, 50, 46; 126/101, 110 R, 99 R; 165/DIG. 2

[56] References Cited

U.S. PATENT DOCUMENTS

| | | | |
|---|---|---|---|
| 316,772 | 4/1885 | Gessner | 237/52 |
| 765,092 | 7/1904 | MacFadyen | 165/DIG. 2 |
| 3,913,663 | 10/1975 | Gates | 165/DIG. 2 |

FOREIGN PATENT DOCUMENTS

| | | | |
|---|---|---|---|
| 848628 | 11/1939 | France | 237/52 |

*Primary Examiner*—Albert J. Makay
*Assistant Examiner*—Henry Bennett
*Attorney, Agent, or Firm*—Mattern, Ware, Stoltz & Fressola

[57] ABSTRACT

By providing a heat exchanging vessel which employs no moving parts and is interposed in the exit flue between the furnace and the chimney, an efficient energy recovery system is achieved which prevents hot air from escaping without any benefit. In the preferred embodiment, the energy saving system of this invention optimizes normal convection currents and air flow paths to eliminate the necessity for any moving parts or electrically driven equipment, as well as incorporating fin members to increase surface areas for heat transfer and heat radiation.

7 Claims, 5 Drawing Figures

ENERGY RECOVERY SYSTEM

TECHNICAL FIELD

This invention relates to energy conservation equipment and more particularly to heat exchanging systems for use with furnaces in order to recover energy from otherwise unused heated air.

BACKGROUND ART

With the rising cost of energy and its effect on expense for heating homes and offices, various attempts have been made to improve the efficiency of the heating systems by reducing energy consumption and recovering heat that might otherwise be wasted. However, these systems suffer from several drawbacks and have not been able to provide a simple, dependable, and efficient system which employs otherwise wasted heat and converts such wasted heat directly into useable heat.

One of the principal losses of heat, and the energy needed to create that heat, is found in the heated air exiting from the furnace up and out of the chimney. Consequently, many prior art systems have been developed to attempt to solve this energy loss. However, these systems suffer from various drawbacks and have been unable to efficiently achieve their major goal. Principally, these prior art systems suffer from the need for additional equipment which is prone to fail. Of the several different systems which have been developed, the only system of which I am aware which is related to my invention is U.S. Pat. No. 4,147,303. In this patent, a heat saving smoke pipe attachment is disclosed. However, the attachment disclosed therein suffers from the difficulties discussed by requiring electrically driven equipment to establish the requisite air flow. In addition, the attachment fails to provide sufficient heat transfer capability which would fully employ the heat lost from the heated air exiting from the furnace flue.

Therefore, it is a principal object of this invention to provide an energy recovery system which is capable of optimizing the recovery of heat from the air exiting from a furnace to its chimney, and using the recovered heat.

Another object of the present invention is to provide an energy recovery system having the characteristic features described above which requires no moving parts and employs natural convection currents and air flow to achieve the energy recovery.

Another object of the present invention is to provide an energy recovery system having the characteristic features described above which is simple to manufacture and quickly and easily installable in position for operation.

Another object of the present invention is to provide an energy recovery system having the characteristic features described above which is readily positionable for maximum heat recovery as well as optimum distribution of the recovered heat to useable areas, without in any way degrading or reducing the efficacy of the furnace.

Other and more specific objects will in part be obvious and will in part appear hereinafter.

DISCLOSURE OF THE INVENTION

In typical furnace operations, the temperature of the air exiting from the furnace is about 500° F. when the furnace is on. During the heating season, the heating requirements for the house or building require the repeated use of the furnace and result in the loss of considerable heat up the chimney each time the furnace is running.

Of course, the cycle time for any furnace depends upon many variable factors, the principal ones being the area being heated, the temperature difference between the heated zone and the outside, and the presence of a domestic hot water system being heated by the furnace. In general, domestic hot water systems require the furnace to cycle on at least every two hours, in order to maintain the water at the desired temperature.

In many instances during the heating season, especially when the heating demands are the greatest, a furnace remains running continuously for lengthy periods of time, or is repeatedly cycled on after short off periods. Any heated air exiting from the furnace to the chimney contains a substantial number of lost BTU'S, and the quantity of heated air exiting the furnace to the chimney during these long cycle runs of a furnace produces a sizeable heat loss, since the temperature of the flue gas is maintained at about 500° F. throughout the entire time that the furnace is running. However, by employing the energy recovery system of this invention, much of this otherwise wasted heat is employed and used to its optimum.

The energy recovery system of the present invention employs this wasted heat and overcomes all of the prior art difficulties by providing a heat exchanging vessel inserted directly in the output flue line of the furnace, between the furnace and the chimney. In this way, maximum heat recovery is achieved from the hot air exiting from the furnace to the chimney.

In addition, the heat exchanging vessel of this invention incorporates a separate, contained flow path for the ambient air from the furnace room, and channels the ambient air flow directly through the flow path of the furnace heated air. In this way, heat transfer from the hot flue gas exiting from the furnace is maximized to warm the ambient air from the furnace room.

In the preferred embodiment, the heat exchanging vessel incorporates means for dividing the flow of the hot furnace flue gas and controllingly channeling the divided flows through circuitous paths. As a result, maximum heat transfer surface area is achieved and maximum heat recovery is attained.

The heat exchanging vessel of the present invention preferably also incorporates a plurality of fin members disposed about portions of the heat exchanger and extending both inwardly and outwardly therefrom. These fins are preferred since they create increased heat transfer surface area for absorbing heat from the hot furnace exhaust gas and for transferring the absorbed heat to ambient air.

In the preferred embodiment, the energy recovery system of this invention incorporates a separate flow path which channels ambient air through the heat exchanging vessel for warming and delivers the warmed air directly to a heated zone in the home or building. With this construction, warm air is delivered directly where needed, without any additional expense for achieving the raised temperature levels of this warmed air.

In the system of this present invention, no moving parts are required and no electrically driven fans, motors, or controllers are employed. The entire heat recovery system of this invention achieves the recovery of heat from the hot gas exiting from the furnace and employs that hot gas to heat the ambient air in the furnace room, if desired, while also delivering the resulting heated air directly to the living quarters or heated zones. Electrically driven circulation equipment is eliminated by using natural convention, since air rises when heated and falls when cooled. With the system of this invention, heat recovery is achieved, energy expenses are reduced, and an efficient, foolproof, reliable system is realized.

The invention accordingly comprises the features of construction, combination of elements, and arrangement of parts which will be exemplified in the construction hereinafter set forth, and the scope of the invention will be indicated in the claims.

BEST MODE FOR CARRYING OUT THE INVENTION

Figure 1:
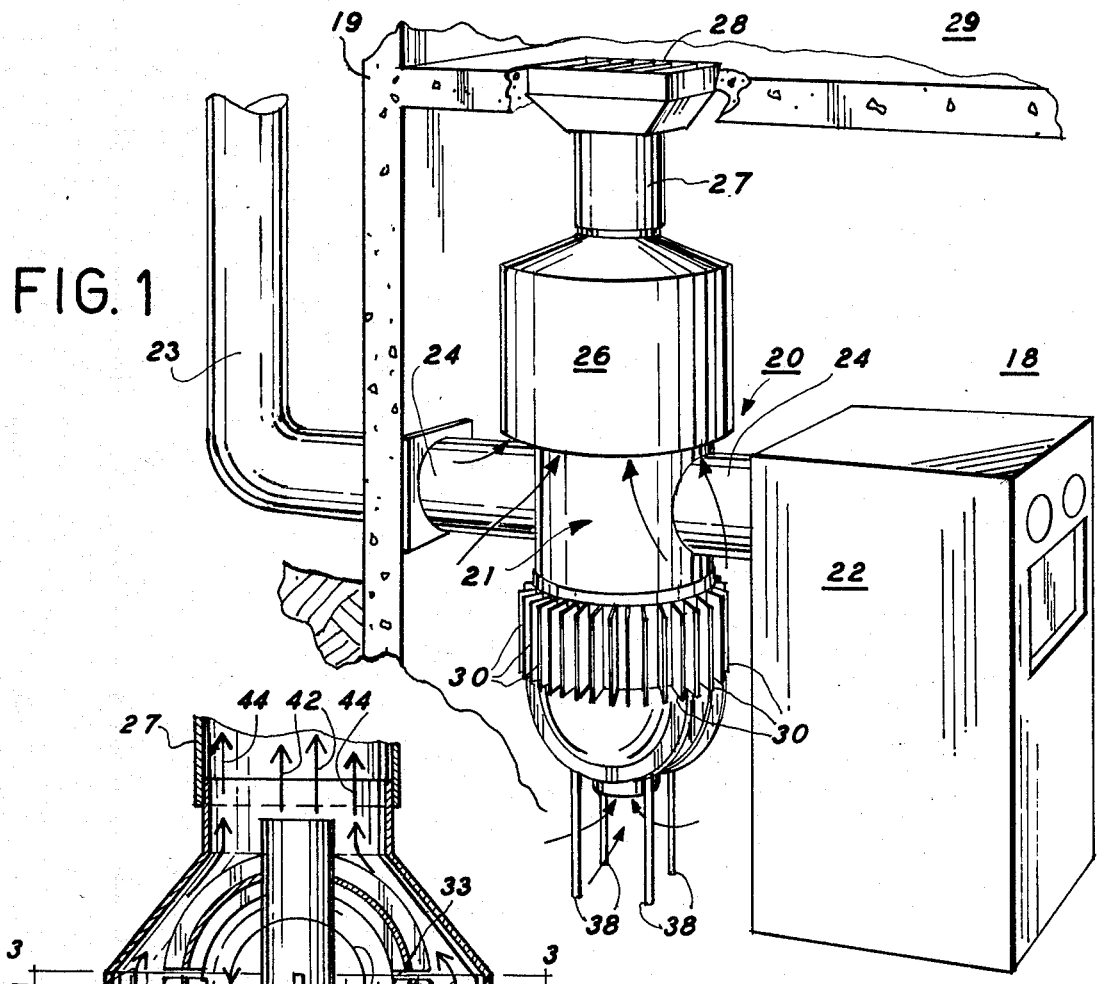
FIG. 1 is a perspective view of the energy recovery system of the present invention shown in its installed position in the exit flue between a furnace and a chimney.

In FIG. 1, a typical installation is shown with a furnace 22 located in the basement or furnace room 18 of a house or building 19, with the closest occupied area being heated zone 29 on the first floor of building 19. In addition, chimney pipe 23 extends from building 19 upwardly, to carry the hot air and combustion gases away from furnace 22 and basement 18.

As shown in FIG. 1, energy recovery system 20 of the present invention comprises a heat exchanger 21 which is inserted directly in the exit flue line 24 of furnace 22, between furnace 22 and chimney pipe 23. Preferably, energy recovery system 20 also incorporates an air flow directing shroud 26 encircling the top of heat exchanger 21, and duct means 27 and 28. With this construction, ambient air is controllingly channelled to be warmed within heat exchanger 21 and delivered to heated zone 29 of building 19.

Figure 2:
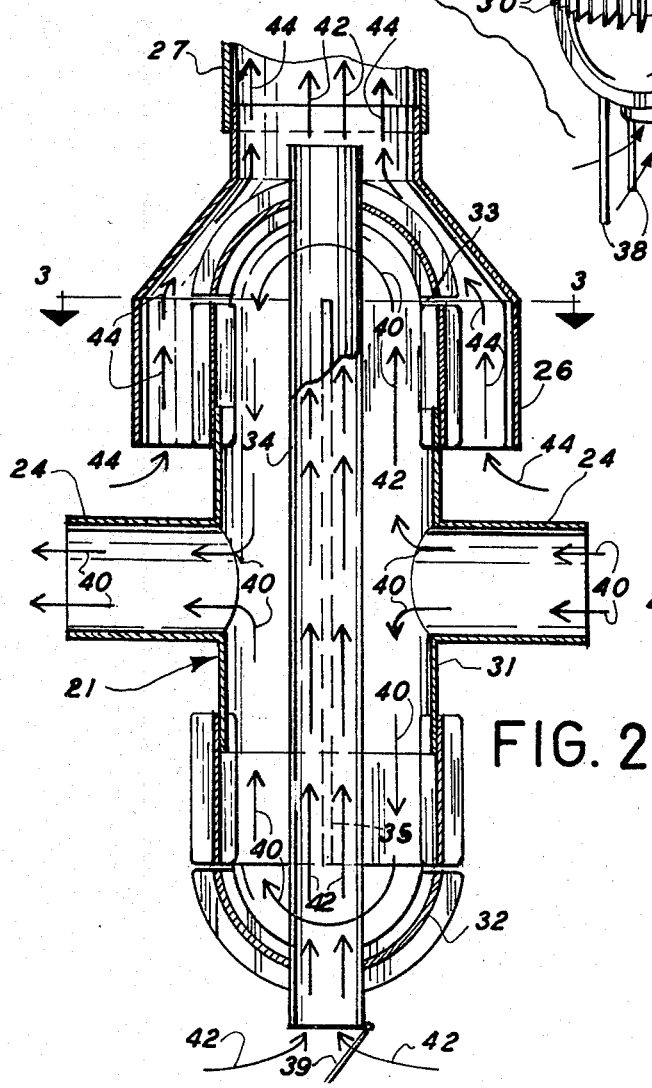
FIG. 2 is a cross sectional side elevation view of the heat exchanging vessel of the energy recovery system of this invention taken along line 2—2 of FIG. 3.
Figure 3:
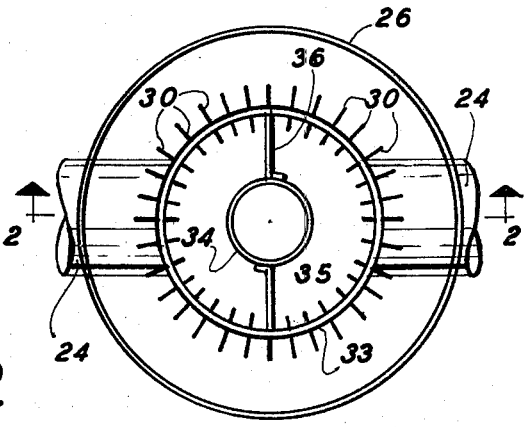
FIG. 3 is a cross sectional top plan view of the heat exchanging vessel of the energy recovery system of the present invention taken along line 3—3 of FIG. 2.

As shown in FIGS. 2 and 3, the vertically elongated heat exchanging vessel 21 comprises a substantially cylindrical outer wall portion 31, and upper and lower heat absorbing end portions 32 and 33. In addition, duct member 34 extends longitudinally through substantially the central axis of vertical cylindrical body portion 31, entering through lower end portion 32 and exiting through upper end portion 33. Preferably, duct member 34 comprises an elongated substantially cylindrical shape and incorporates baffle deflector fins 35 and 36 extending outward from both sides thereof in substantially the same plane, spanning the space between internal duct 34 and outer wall 31. Preferably, deflector fins 35 and 36 extend substantially the entire length of heat exchanger 21 except from the dome-shaped ends 32 and 33, and are positioned substantially perpendicular to the central axis of furnace exit flue 24. In addition, heat exchanger 21 also preferably incorporates a plurality of radiating fins 30 disposed about both lower and upper portions 32 and 33, in order to provide additional heat exchanging surface area for radiating heat to the basement 18, as well as heating the ambient air flowing under shroud 26.

As shown in FIGS. 1 and 2, central body portion 31 of heat exchanger 21 is positioned directly in the flow path of exit flue 24 of furnace 22. In this way, the hot gas exiting from furnace 22 must pass through heat exchanger 21 before it can exit to chimney 23. As a result, maximum heat recovery from this hot air, with its 500° F. temperatures, is assured.

As shown by reference numeral 40 in FIG. 2, the flow path of the hot gas forceably driven from furnace 22 into exit flue 24 enters heat exchanger 21 and is dividingly deflected into opposite flow directions, either upwardly or downwardly, due to divider or baffle deflector fins 35 and 36 and central duct 34. Once the hot air flow reaches either the top of the bottom of heat exchanger 21, where deflector fins 35 and 36 terminate, the gas streams move to the opposite sides of divider or baffle deflector fins 35 and 36 and then flow towards each other, either downwardly or upwardly, until the flow paths converge at the chimney portion of exit flue 24, whence the stream flows directly to chimney 23. Since the gas exiting from furnace 22 is at its maximum temperature when the furnace is ON, and the gas flow exiting from furnace is only fan forced during the furnace's ON cycles, it is readily apparent that the flow path represented in FIG. 2 for the gas flow exiting from furnace 22 is easily achieved by the hot gas forced from furnace 22 to chimney 23.

In the preferred embodiment, end portions 32 and 33 comprise heat absorbing castings wherein the hot gas exiting from furnace 22 and passing inside end portions 32 and 33 transfers a portion of its heat to end portions 32 and 33, which absorb and retain this heat for dissipation to the ambient air peripherally surrounding or passing portions 32 and 33. In this way, optimum heat recovery is achieved from the hot gas exiting from the furnace, with a portion of the recovered heat being retained in the heat exchanger for extended periods of time for dissipation and transfer to either the ambient air in basement 18 or to heated zone 29, even when furnace 22 is in an OFF cycle.

By separating the hot flue gas driven from furnace 22 during its ON cycle and controllably dividing this hot gas to flow in two separate paths, with heat absorbing zones being positioned on both sides of the hot gas flow path, maximum heat recovery is achieved from this exiting hot gas. As has been found, and as shown below, the forced hot furnace gas which exits from heat exchanger 21 has an average temperature of about 300° F., as opposed to the incoming hot gas with its temperature of about 500° F. As a result, 200° F. of otherwise lost heat is continuously recovered and employed for directly heating either basement 18 or heated zone 29.

By referring to reference numerals 42 and 44 in FIG. 2, the natural flow of ambient air through heat exchanger 21 can best be understood. As the ambient air surrounding heat exchanger 21 is warmed from the heat radiating from heat exchanger 21, some of the ambient air enters duct 34 at the base of heat exchanger 21 and continues to flow by convection upwardly through duct 34 as shown by arrows 42. As this air flows through duct 34, the air is continuously being warmed to a higher temperature by absorbing heat from (1) the hot gas forced through heat exchanger 21 by furnace 22 when the furnace is in its ON cycle, and (2) heat retained by heat exchanger 21 and dissipated to the surrounding area when furnace 22 is in its OFF cycle.

Similarly, ambient air warmed by the outer surface of heat exchanger 21 enters shroud 26 and moves by convection upwardly between shroud 26 and upper portion 33 of heat exchanger 21. This air flow is represented by numeral 44 in FIG. 2.

As shown in FIG. 2, warmed air paths 42 and 44 converge at the top of heat exchanger 21 and are channelled directly through duct 27 and register 28 to heated zone 29. In this way, the air warmed by heat exchanger 21, using the hot gas from furnace 22, is delivered directly to the heated area, thereby reducing the necessity for heating the area using only furnace 22 and the fuel required by furnace 22.

Fins 30 which peripherally surround and extend from lower portion 32 and upper portion 33 of heat exchanger 21 provide added assurance that heat is extracted from the hot gas exiting from furnace 22 and transferred to the ambient air. Fins 30 which peripherally surround upper portion 33 transfer the absorbed heat to the air flowing along the direction shown by reference numeral 44, thereby heating the ambient air and delivering this warmed air to heated zone 29. It has been found that the warmed air exiting from register 28 to heat zone 29 reaches a temperature of about 150° F. This warmed air represents incoming ambient air having a temperature of about 70° F. with that air temperature being raised to 150° F. by the heat extracted and recovered from the otherwise wasted hot gas exiting to chimney pipe 23.

Although heat exchanger 21 is exposed to the 500° F. hot flue gas only when furnace 22 is in an ON cycle, the absorption and retention of heat by upper portion 33 and lower portion 32 allows these portions to radiate the retained heat long after furnace 22 has turned OFF. Consequently, ambient air is continuously warmed at the entrance to shroud 26 and moves upwardly through shroud 26, along flow path 44, being continuously warmed during its upward movement until the warmed air reaches register 28 and heated zone 29.

Similarly, ambient air follows flow path 42 both during the furnace ON cycles and OFF cycles, since the surrounding air is heated by lower portion 32 and, as the air rises, enters duct 34 and rises through duct 34 to register 28, as the rising air is continuously warmed from the heat retained in heat exchanger 21. However, the rate of air flow through duct 34 is greater when the furnace is in its ON cycle and the air passing through duct 34 is heated more rapidly and to a higher temperature.

As shown in FIG. 1, heat exchanger 21 is preferably mounted above the floor of basement 18, in order to assure that the ambient air in basement 18 has easy access to the entrance of duct 34. As represented in FIG. 1, this can most easily be achieved by mounting heat exchanger 21 on support legs 38.

In addition, as shown in phantom in FIG. 2, central duct 34 preferably incorporates a movable door 39 which is pivotally hinged to the inlet portal of duct 34. Door 39, and its associated latch means, is normally maintained during the heating season in the open position in order to allow the ambient air to enter duct 34 as described above. However, during the summer months, when the furnace is in little use and warm air delivery to zone 29 is not desired, door 39 can be moved to its closed position and latched in place, in order to prevent unwanted warmed air from being delivered to zone 29. In addition, register 28 is preferably of conventional construction and also incorporates vent means for closing the register when warmed air is not desired.

Figure 4:
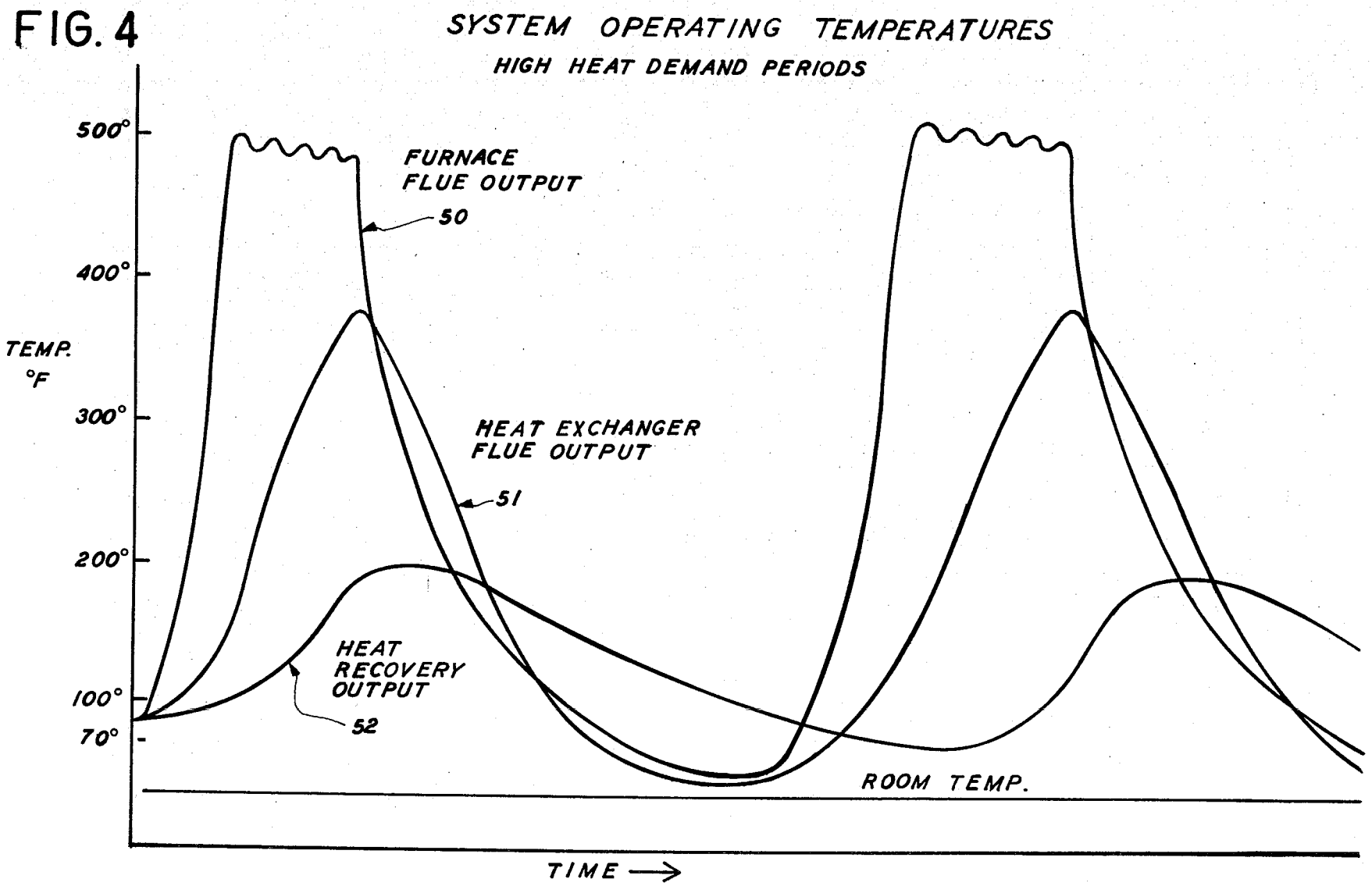
FIG. 4 is a graph schematically representing the operating temperatures with respect to time of three specific points in the energy recovery system of this invention during high heat demand periods.
Figure 5:
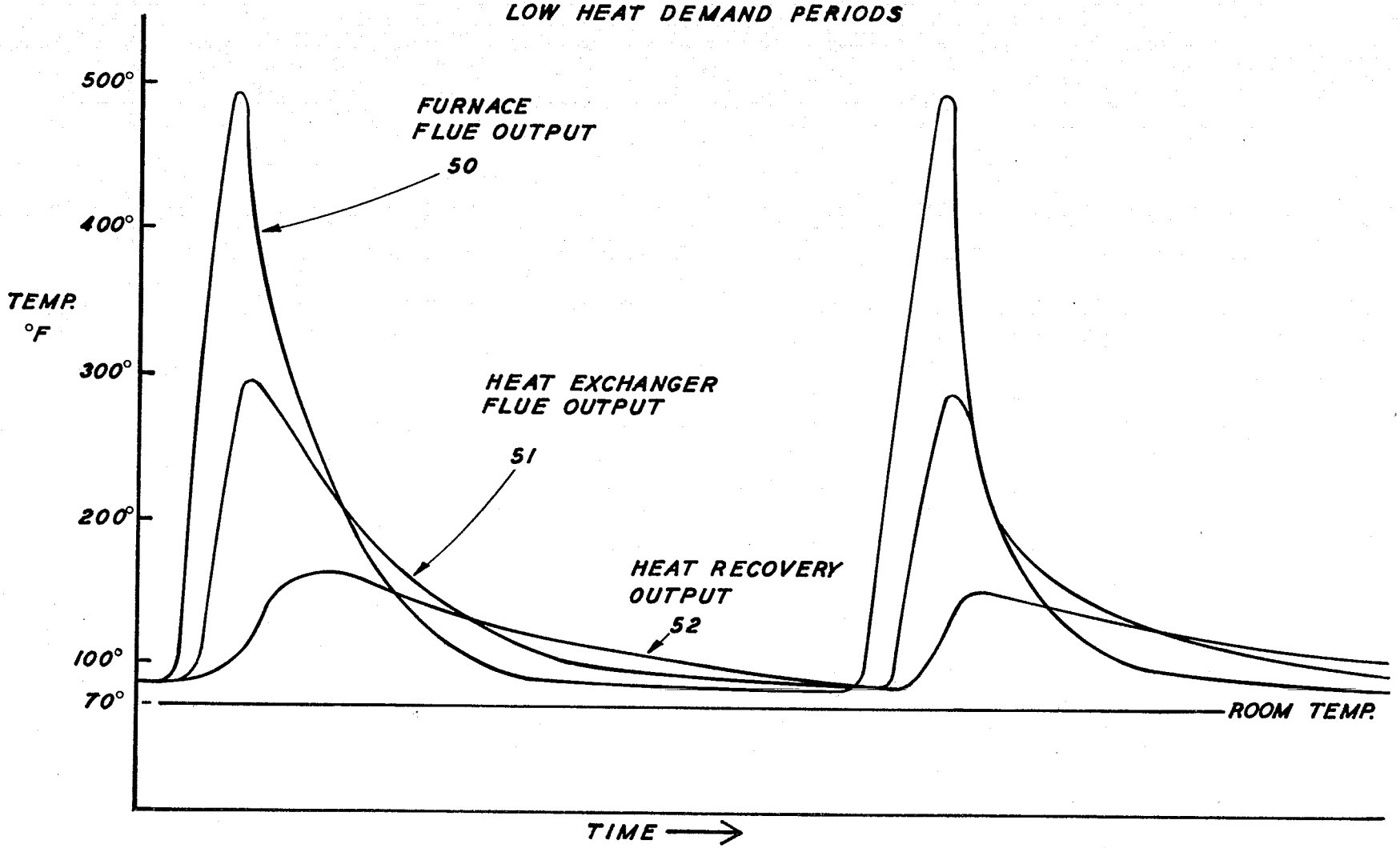
FIG. 5 is a graph schematically representing the operating temperatures with respect to time of three specific points in the energy recovery system of this invention during low heat demand periods.

In FIGS. 4 and 5, temperature charts are shown which depict the advantageous results achieved with energy recovery system 20 of the present invention. In FIG. 4, the chart depicts the operation of furnace 22 during high heat demand periods. In FIG. 4, line 50 represents the temperature variations of the hot gas in furnace flue output 24, line 51 represents the temperature variations of the air exiting heat exchanger 21 to chimney pipe 23, and line 52 represents the temperature variations of the warmed air exiting through the top of heat exchanger 21 to the heated zone 29.

As shown in FIG. 4, the hot gas temperature in furnace flue output 24 (line 50) rapidly reaches a temperature of about 500° F., when the furnace is ON, and during a high heat demand period is maintained at the 500° F. level for a substantial period of time. When the furnace automatically shuts OFF, the output gas temperature drops towards ambient. The temperature represented by line 51, which is the gas temperature in the output flue of heat exchanger 21 exiting towards chimney 23, follows a similar pattern wherein the temperature rises to a level of about 300° F. when the furnace is ON and then drops towards room temperature when the furnace is OFF.

Line 52, however, which depicts the temperature of the air heated in heat exchanger 21 and delivered to heated zone 29, clearly shows that this air temperature rises to about 150° F. each time the furnace is in the ON cycle, and then slowly drops towards the ambient room temperature, when the furnace is OFF. As clearly represented by line 52, a substantial amount of otherwise wasted heat is extracted from the furnace hot air output and converted directly into heated air delivered directly to the particular area where heat is required. In addition, line 52 clearly shows that heat exchanger 21 retains the heat absorbed from the furnace hot gas output and slowly dissipates this retained heat, thereby prolonging the efficacy of the heat exchanger 21 and its ability to deliver warmed air to heated zone 29.

In FIG. 5, a similar chart is shown which represents the performance of heat exchanger 21 during low heat demand periods. As shown therein, the temperature of the gas in the furnace flue output, represented by line 50, rapidly reaches a temperature level of 500° F. when the furnace is ON, but is maintained at the 500° F. level for only a comparatively short period of time, until the furnace has met the heat demand and automatically shuts OFF. At this time, the temperature in furnace flue output 24 drops towards the ambient temperature. Line 51, representing the temperature in the flue output from heat exchanger 21 being delivered to chimney pipe 23 similarly rapidly climbs when the furnace is ON, reaching a temperature of about 300° F., and then drops towards ambient when the furnace is OFF.

Line 52, representing the temperature of the warm air in duct 27, namely the heat recovered from the hot air from furnace 21 by employing heat exchanger 21, shows the temperature increase of the warmed air to a level of about 150° F. when the furnace is in its ON cycle, and the slow decrease of this temperature towards ambient when the furnace is OFF. As discussed above, the heat removed from the hot gas exiting from furnace 22 and retained by heat exchanger 21 allows the temperature of the warmed air exiting from heat exchanger 21, represented by line 52, to slowly decrease towards ambient when the furnace is in the OFF cycle, while continuously providing warm air to heated zone 29 with the warmed air quickly returning to an elevated temperature of about 150° F. as soon as the furnace returns to the ON cycle.

In normal operation, as shown in FIGS. 4 and 5, the gas temperatures in the furnace flue output 24 and in the heat exchanger flue output to chimney pipe 23 reach their maximum when the furnace is ON, and then drop towards ambient when the furnace is OFF. However, due to the heat retained in furnace 22 and heat exchanger 21, these temperatures do not reach ambient. In addition, the demand for heat or for hot water in the house or building requires the furnace to cycle ON long before these temperatures have reached ambient.

As is readily apparent from the preceding disclosure, the heat recovery system of the present invention is capable of recovering a substantial amount of otherwise wasted energy, and converting that wasted energy into heated air delivered directly to a useable area. In addition, this energy recovery is achieved without the use or need for additional electrically driven equipment to force air circulation.

It will thus been seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the claims are intended to cover all of the generic and specific features herein described and all statements of the scope of the invention which, as a matter of language, might be said to fall therebetween.

Having described my invention, what I claim is new and desire to secure by Letters Patent is:

1. An energy recovery system for installation in a furnace output flue line, comprising A. a heat exchanging vessel adapted for mounting directly in the furnace output flue line and incorporating
   a. an inlet portal for receiving output hot gas from the furnace,
   b. a flue outlet portal for delivering said furnace air to a chimney flue, and
   c. baffle means for controllingly diverting the furnace output hot gas through a pre-defined path;

B. first duct means positioned within the heat exchanging vessel and extending the entire length thereof, substantially along the central vertical axis of the heat exchanging vessel, and incorporating
   a. an inlet portal located at the bottom of said first duct means for receiving ambient air,
   b. a first outlet portal positioned at the top of said first duct means for delivering the warmed ambient air, and
   c. a duct defining wall member cooperatively associated with the interior of the heat exchanging vessel to form therewith a heat transfer zone wherealong the ambient air rising through the duct means is continuously warmed; and C. a shroud member peripherally surrounding the upper portion of the heat exchanging vessel and comprising
   a. a shroud inlet portal formed at the base of said shroud for receiving ambient air, and
   b. a second outlet portal spaced above said shroud and positioned for delivering the warmed ambient air to a pre-determined heating zone,
   wherein the first outlet portal from said first duct means and the second outlet portal of said shroud merge within second duct means for carrying said warmed air directly to a zone wherein heated air is required, whereby the total aspiration of air is increased.

2. The energy recovery system defined in claim 1, wherein said heat exchanging vessel incorporates a plurality of radiating fins formed about the upper peripheral surface of the heat exchanging vessel and extending both inwardly and outwardly therefrom, thereby increasing the heat exchanging surface area between the heat exchanging vessel and the peripherally encircling shroud.

3. The energy recovery system defined in claim 1, wherein said baffle means is defined as extending substantially radially from the entire length of the first duct means, thereby assuring deflection of the incoming hot gas from the furnace both upwardly and downwardly through substantially the entire heat exchanging vessel.

4. The energy recovery system defined in claim 1, wherein said first duct means comprises a movable door at the inlet portal thereof, in order to allow closure of said first duct means.

5. The energy recovery system defined in claim 1, wherein said heat exchanging vessel is further defined as comprising a plurality of radiating fins formed along the bottom portion thereof and extending both inwardly and outwardly from the external wall of the heat exchanging vessel, providing additional surface area for radiating heat to the furnace room.

6. The energy recovery system defined in claim 1, wherein said heat exchanging vessel comprises heat absorbing material forming a major portion thereof, with the heat absorbing material being capable of quickly absorbing heat from the furnace output hot air and retaining the absorbed heat for slow dissipation.

7. The energy recovery system defined in claim 1, wherein said heat exchanging vessel is spaced away from the floor with the base thereof fully ventilated, thereby assuring free flow of the ambient air into the inlet portal of the duct means.

* * * * *